US007664450B2

(12) United States Patent
Aze et al.

(10) Patent No.: US 7,664,450 B2
(45) Date of Patent: Feb. 16, 2010

(54) IMAGE FIXING APPARATUS AND IMAGE FORMING APPARATUS

(75) Inventors: Norihiko Aze, Kanagawa-ken (JP); Motokazu Hasegawa, Kanagawa-ken (JP); Susumu Matsusaka, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 235 days.

(21) Appl. No.: 11/812,150

(22) Filed: Jun. 15, 2007

(65) Prior Publication Data

US 2008/0003030 A1 Jan. 3, 2008

(30) Foreign Application Priority Data

Jun. 16, 2006 (JP) ..... 2006-166987

(51) Int. Cl.
*G03G 15/20* (2006.01)

(52) U.S. Cl. ..... 399/329; 399/330

(58) Field of Classification Search ..... 399/107, 399/122, 320, 328, 329, 330; 219/216, 619
See application file for complete search history.

(56) References Cited

U.S. PATENT DOCUMENTS

| | | | | |
|---|---|---|---|---|
| 6,021,303 | A * | 2/2000 | Terada et al. | 399/328 |
| 7,486,924 | B2 * | 2/2009 | Ito | 399/333 |
| 2002/0020699 | A1 | 2/2002 | Nagahira et al. | |
| 2005/0286938 | A1 | 12/2005 | Aze et al. | |
| 2006/0056890 | A1 | 3/2006 | Aze et al. | |
| 2006/0289420 | A1 | 12/2006 | Hasegawa et al. | |
| 2007/0242988 | A1 * | 10/2007 | Seo et al. | 399/328 |

FOREIGN PATENT DOCUMENTS

| | | | |
|---|---|---|---|
| EP | 0 855 630 | | 7/1998 |
| JP | 2000-075702 | | 3/2000 |
| JP | 2000-150131 | | 5/2000 |
| JP | 2000-162912 | | 6/2000 |
| JP | 2000-214703 | | 8/2000 |
| JP | 2002-082549 | | 3/2002 |
| JP | 2002-260836 | | 9/2002 |
| JP | 2003-215954 | | 7/2003 |
| JP | 2003-330291 | | 11/2003 |
| JP | 2003-347030 | | 12/2003 |
| JP | 2006-011217 | | 1/2006 |
| JP | 2006-079949 | | 3/2006 |
| JP | 2007-41309 | * | 2/2007 |
| JP | 2007047224 | | 2/2007 |
| JP | 2007079131 | | 3/2007 |
| WO | WO 03/043379 A1 | | 5/2003 |

OTHER PUBLICATIONS

European Search Report.

* cited by examiner

*Primary Examiner*—Hoan H Tran
(74) *Attorney, Agent, or Firm*—Harness, Dickey & Pierce, P.L.C.

(57) ABSTRACT

An image fixing apparatus stably maintains high efficiency in heat generation and reduces excessive heat and loss of electric power consumption for fixing image. In at least one embodiment, the image fixing apparatus includes a magnetic flux generating member to generate a magnetic flux, and a heat member to generate heat with the magnetic flux. The heat member includes a first heat layer and a second heat layer having a relatively higher volume resistivity than the first heat layer, and having different thickness and/or different volume resistivity depending on a position in the width direction of the second heat layer. Portions of the magnetic flux generating member face different sides of the heat member.

20 Claims, 12 Drawing Sheets

IMAGE FIXING APPARATUS AND IMAGE FORMING APPARATUS

PRIORITY STATEMENT

The present patent application claims priority under 35 U.S.C. §119 upon Japanese patent application No. 2006-166987, filed in the Japan Patent Office on Jun. 16, 2006, the content and disclosure of which is hereby incorporated by reference herein in its entirety.

BACKGROUND

1. Field

Example embodiments generally relate to an image fixing apparatus and an image forming apparatus, and more particularly to an image fixing apparatus utilizing electromagnetic induction heating system, which is used for an image forming apparatus such as printers, copying machines, facsimiles, etc.

2. Discussion of the Background

A use of background image fixing apparatus utilizing electromagnetic induction heating system reduces a rising time of an image forming apparatus and saves energy.

In a background image fixing apparatus, an electromagnetic induction heating system includes a support roller serving as a heat roller, an auxiliary fixing roller serving as a fixing roller, a fixing belt which is tightly stretched by the support roller and the auxiliary fixing roller, an induction-heating device that counters the support roller with the fixing belt therebetween, a pressing roller which is in contact with the fixing belt on the auxiliary fixing roller, etc. The induction-heating device includes a coil member (an excitation coil) that extends in a width direction of the fixing device (the direction perpendicular to the feeding direction of a recording medium), a core member, etc.

The fixing belt is heated at a position in which the fixing belt faces the induction-heating device. A toner image on a recording medium is conveyed to a position between the auxiliary fixing roller and the pressing roller, and heated by the fixing belt, resulting in fixation of the toner image on the recording medium. In more detail, applying the coil member with a high frequency alternate current causes a magnetic field around the coil member, thereby generating an eddy current near the surface of the support roller. The eddy current causes a Joule heat due to the resistance of the support roller itself. The fixing belt, which is tightly stretched by the support roller, is heated with the Joule heat. It is known that the background image fixing apparatus using such an electromagnetic induction heating system may increase the temperature (a fixing temperature) of a surface of the fixing belt to a predetermined temperature with small energy and in a short rising time.

Another background image fixing apparatus using an electromagnetic induction heating system includes core members which face the fixing belt while being located at both sides of the fixing belt. Each of the core members faces the fixing belt at the corresponding side of the fixing belt. This technology is used for the purpose of improving heat efficiency in the fixing belt.

Another background image fixing apparatus using an electromagnetic induction heating system controls the Curie point of core members (magnetic core) of an induction-heating part in the width direction of the core members. In more detail, the Curie points at both end portions of the core members in the width direction thereof are lower than the Curie point at the center portion thereof. This technology is used for the purpose of preventing a problem in that the temperature of the fixing belt at both end portions in the width direction thereof excessively increases when a recording medium of small size is fed.

Another background image fixing apparatus using an electromagnetic induction heating system includes a fixing roller having a first heat layer made of a magnetic material and a second heat layer made of a non-magnetic material. The purpose of this construction is to reduce deterioration of the bearing of the fixing roller (heating roller) due to heat of the shaft of the fixing roller. In more detail, the resistivity of the first heat layer is higher than that of the second heat layer. The thickness of the first heat layer is greater than that of the second heat layer. The second heat layer mainly generates heat and the first heat layer made of a magnetic material reduces the magnetic flux, which is emitted from a magnetic flux generating device and reaches the shaft of the fixing roller.

SUMMARY

An embodiment of the present invention is directed to an image fixing apparatus and an image forming apparatus stably maintains high efficiency in heat generation and reduces excessive heat and loss of electric power consumption for fixing image. In example embodiments, an image fixing apparatus may include a magnetic flux generating member configured to generate a magnetic flux, and a heat member configured to generate heat with the magnetic flux including a first heat layer having a given Curie point and, a second heat layer having a higher volume resistivity than the first heat layer, and having different thickness and/or different volume resistivity depending on a position in the width direction of the second heat layer, wherein the magnetic flux generating member faces a front and a back side of the heat member.

Additional features and advantages of the present invention will be more fully apparent from the following detailed description of example embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXAMPLE EMBODIMENTS

Figure 1:
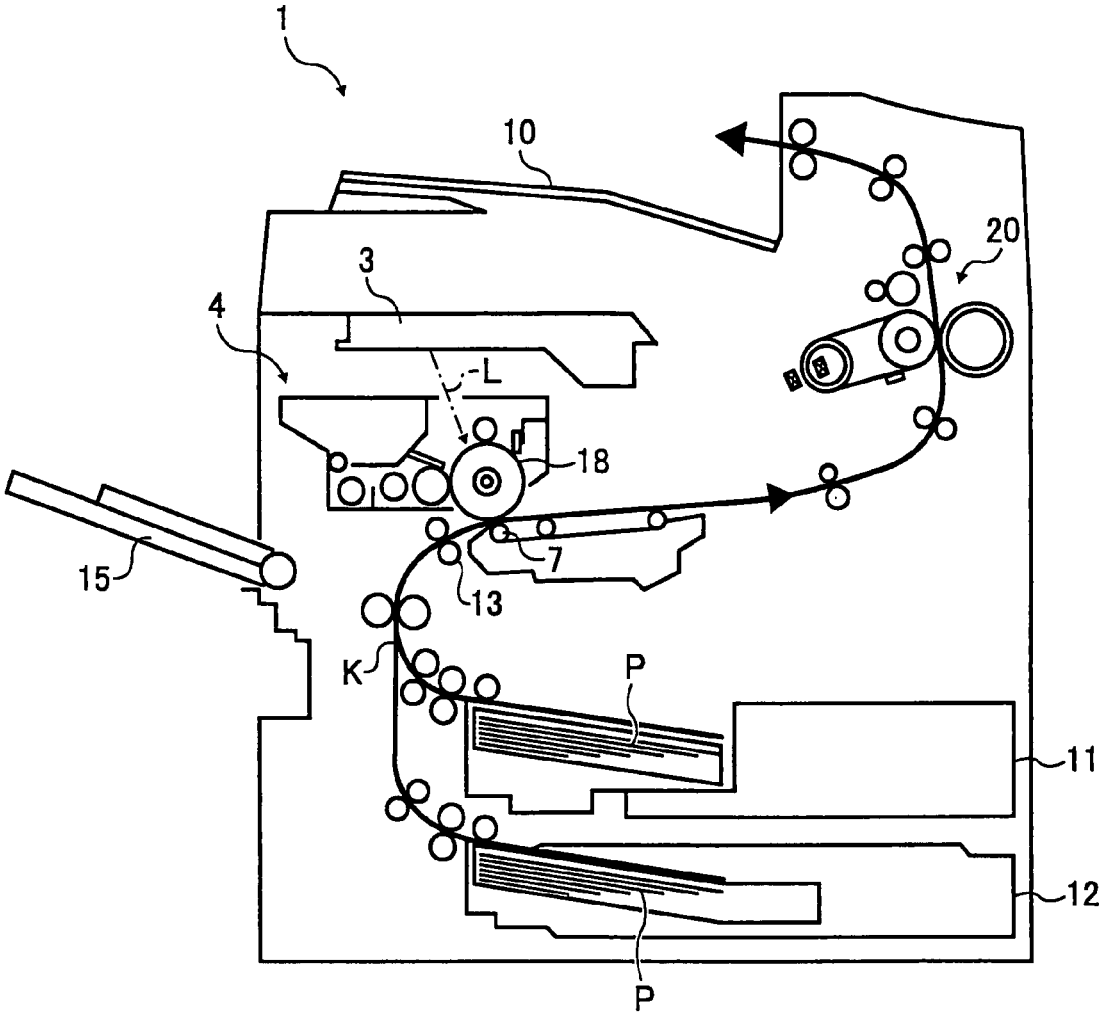
FIG. 1 is a cross-sectional diagram illustrating a configuration of an image forming apparatus according to an example embodiment of the present invention.

It will be understood that if an element or layer is referred to as being "on," "against," "connected to" or "coupled to" another element or layer, then it can be directly on, against connected or coupled to the other element or layer, or intervening elements or layers may be present. In contrast, if an element is referred to as being "directly on", "directly connected to" or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 6, an example of an image fixing apparatus according to example embodiments is explained.

EXAMPLE 1

Figure 2:
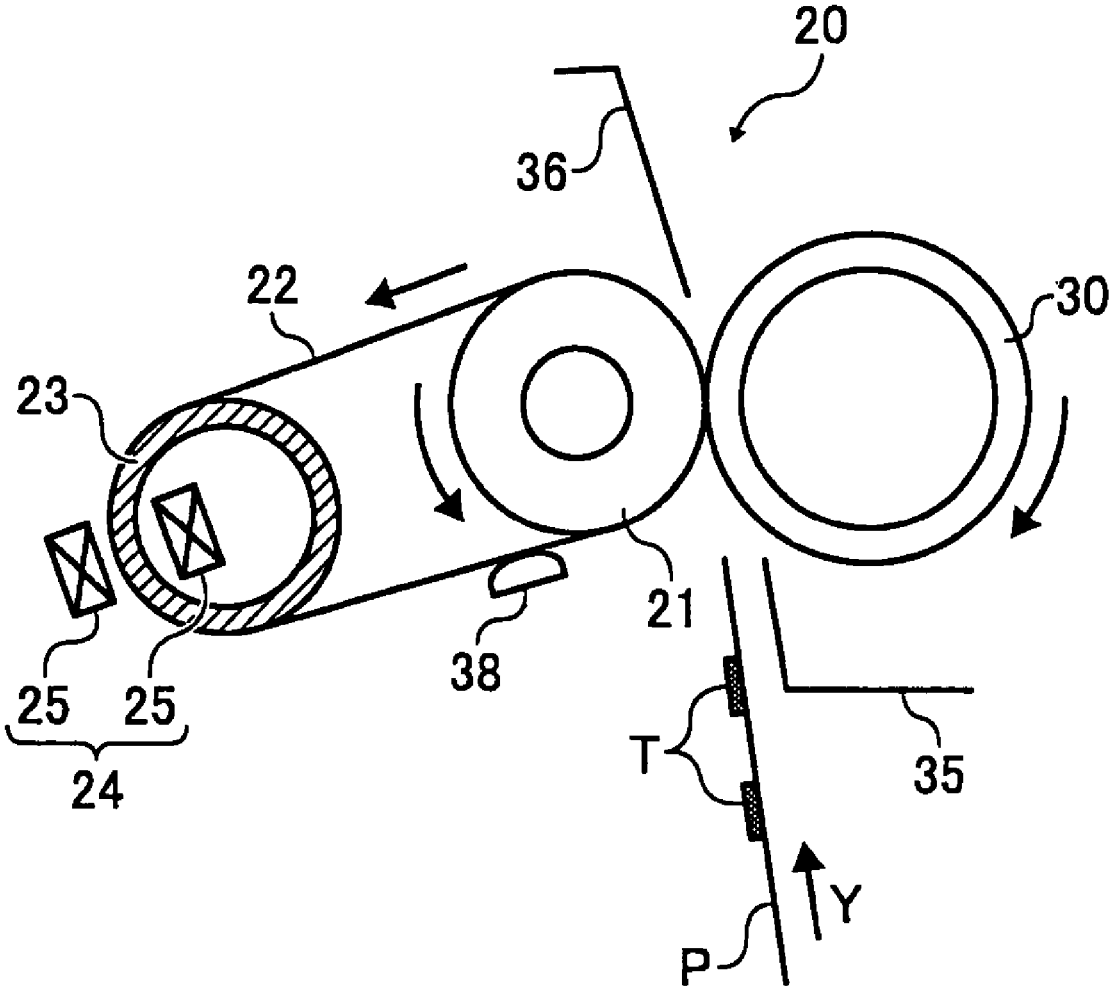
FIG. 2 is a cross-sectional diagram illustrating an example configuration of an image fixing apparatus in the image forming apparatus of FIG. 1.
Figure 3A:
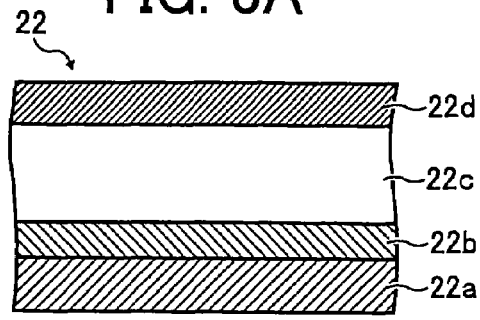
FIG. 3A is a cross-sectional diagram illustrating an example configuration of a part of a fixing belt in the image fixing apparatus of FIG. 2.
Figure 3B:
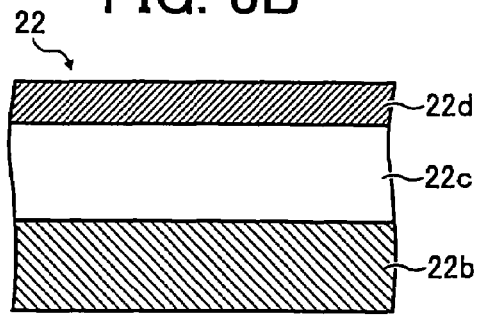
FIG. 3B is also a cross-sectional diagram illustrating an example configuration of a part of a fixing belt in the image fixing apparatus of FIG. 2.
Figure 3C:
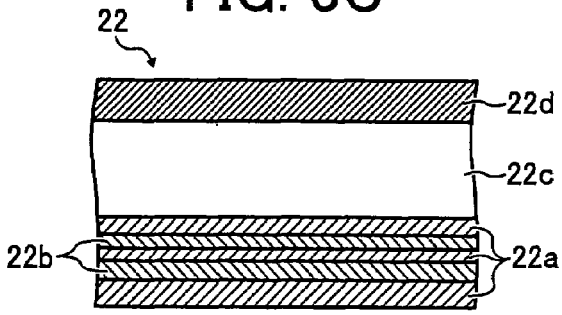
FIG. 3C is also a cross-sectional diagram illustrating an example configuration of a part of a fixing belt in the image fixing apparatus of FIG. 2.
Figure 3D:
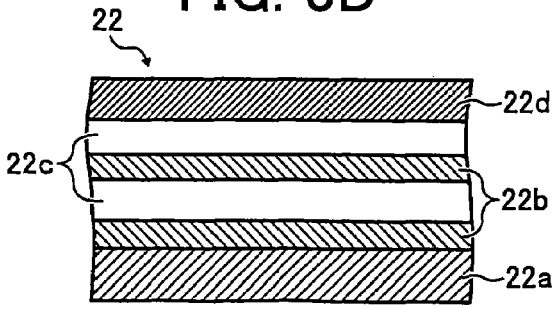
FIG. 3D is also a cross-sectional diagram illustrating an example configuration of a part of a fixing belt in the image fixing apparatus of FIG. 2.
Figure 4:
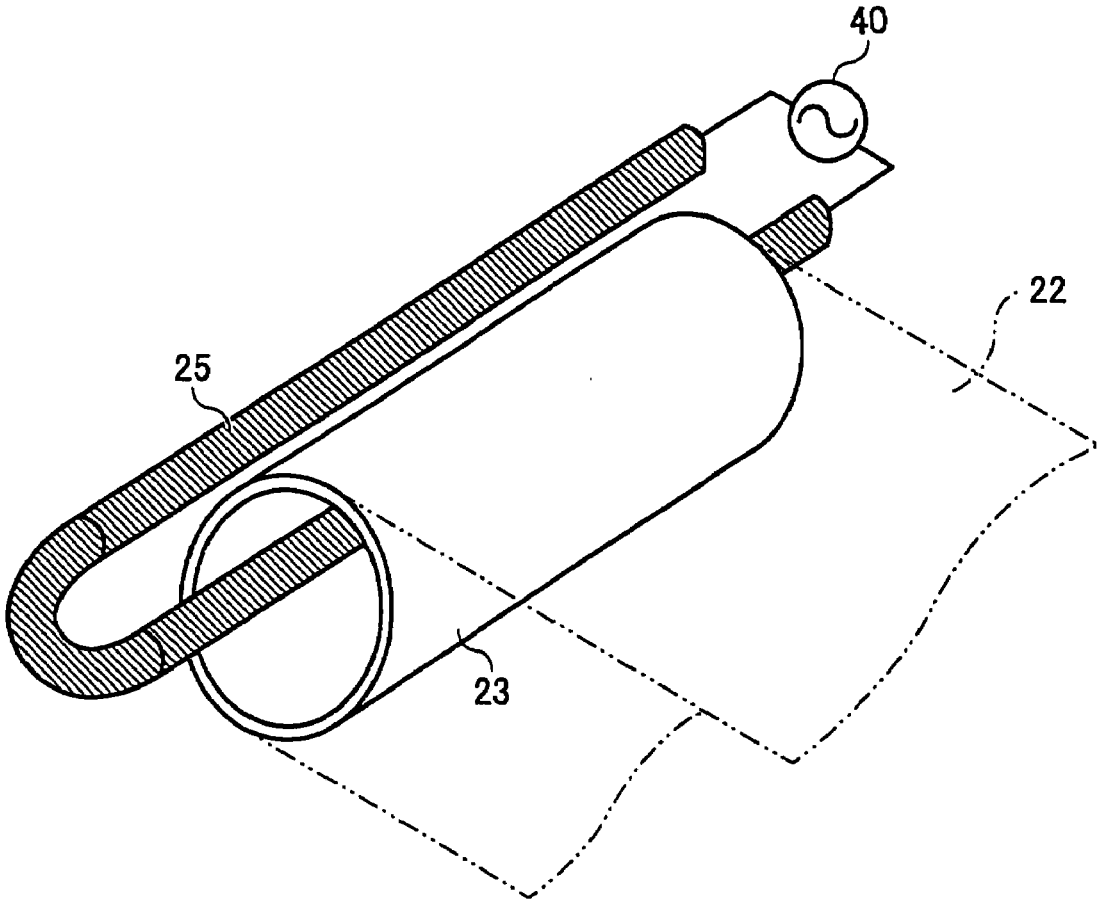
FIG. 4 is a perspective diagram illustrating an example configuration of around an electromagnetic induction heating device of the image fixing apparatus of FIG. 2.
Figure 5:
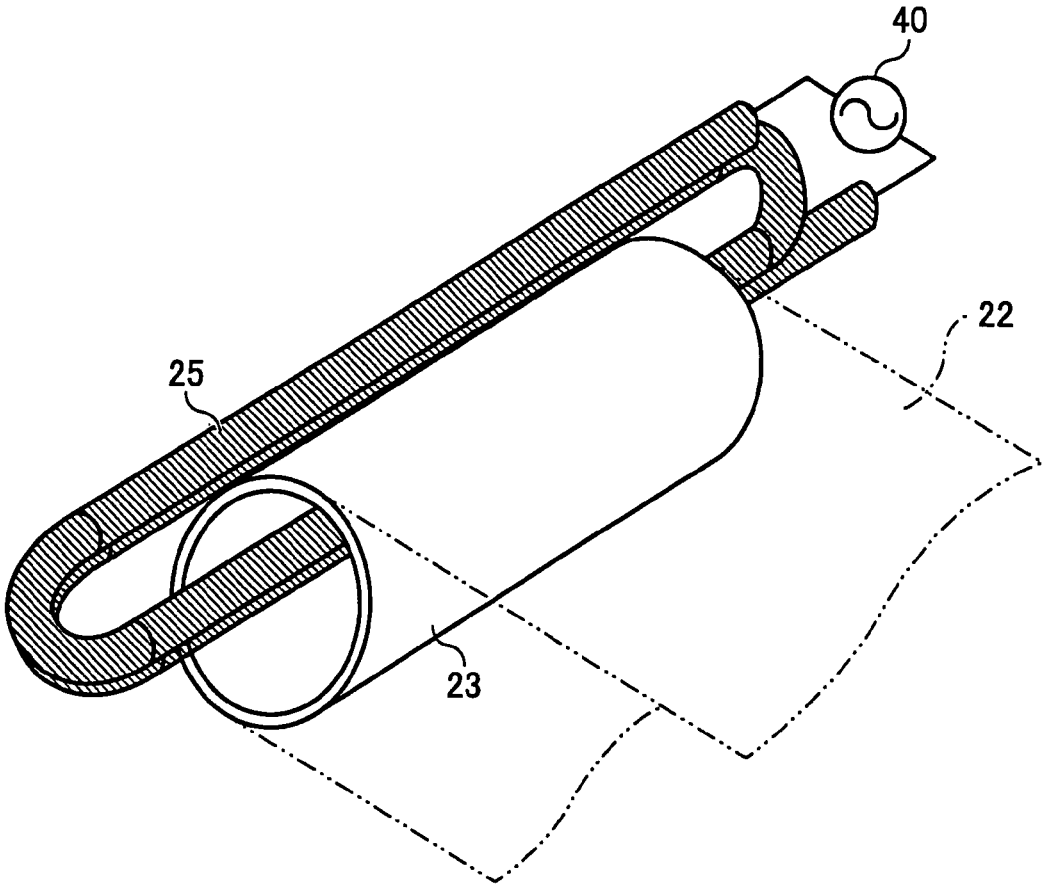
FIG. 5 is also a perspective diagram illustrating an example configuration of around an electromagnetic induction heating device of the image fixing apparatus of FIG. 2.
Figure 6:
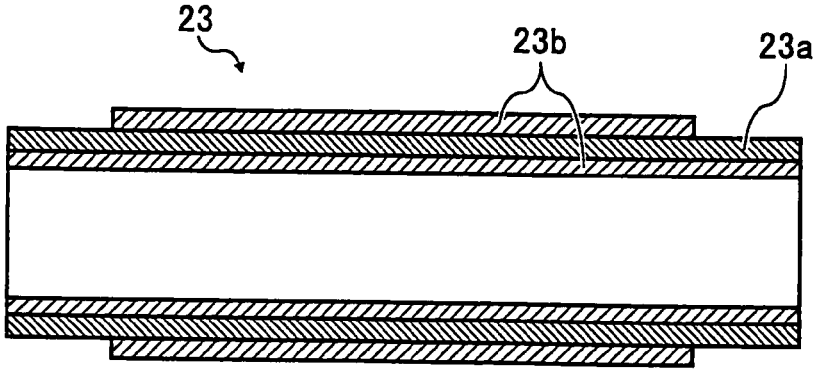
FIG. 6 is a cross-sectional diagram illustrating an example configuration of a support roller of the image fixing apparatus of FIG. 2.
Figure 7A:
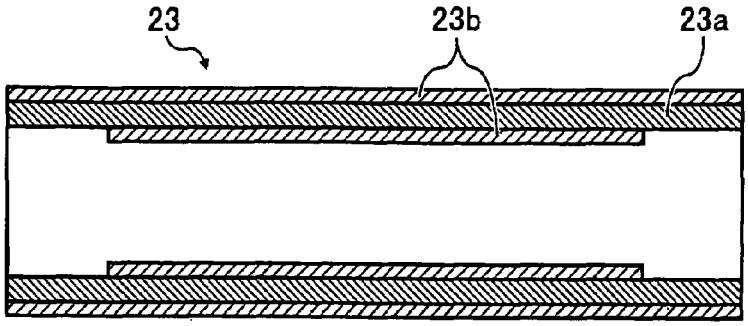
FIG. 7A is a cross-sectional diagram illustrating an example configuration of a support roller of the image fixing apparatus of FIG. 2.
Figure 7B:
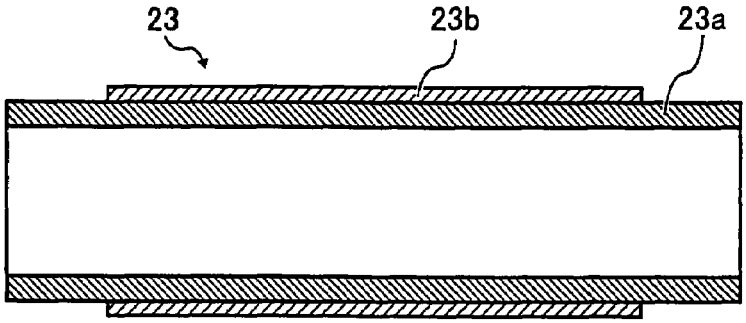
FIG. 7B is a cross-sectional diagram illustrating an example configuration of a support roller of the image fixing apparatus of FIG. 2.
Figure 7C:
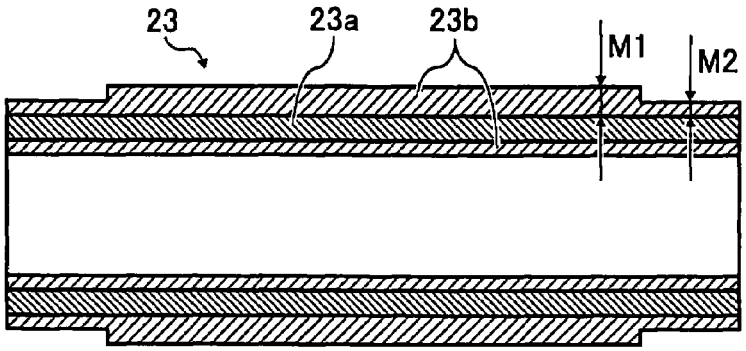
FIG. 7C is a cross-sectional diagram illustrating an example configuration of a support roller of the image fixing apparatus of FIG. 2.
Figure 7D:
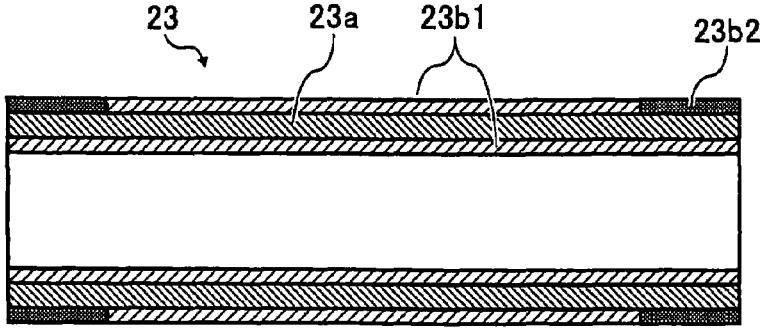
FIG. 7D is a cross-sectional diagram illustrating an example configuration of a support roller of the image fixing apparatus of FIG. 2.

First, the example embodiment of the present invention will be explained by reference to FIG. 1 through FIG. 7D. FIG. 1 is a cross-sectional diagram illustrating a configuration of an image forming apparatus according to an example embodiment of the present invention. FIG. 2 is a cross-sectional diagram illustrating an example configuration of an image fixing apparatus in the image forming apparatus of FIG. 1. FIG. 3A is a cross-sectional diagram illustrating an example configuration of a part of a fixing belt in the image fixing apparatus of FIG. 2. FIG. 3B is also a cross-sectional diagram illustrating an example configuration of a part of a fixing belt in the image fixing apparatus of FIG. 2. FIG. 3C is also a cross-sectional diagram illustrating an example configuration of a part of a fixing belt in the image fixing apparatus of FIG. 2. FIG. 3D is also a cross-sectional diagram illustrating an example configuration of a part of a fixing belt in the image fixing apparatus of FIG. 2. FIG. 4 is a perspective diagram illustrating an example configuration of an electromagnetic induction heating device of the image fixing apparatus of FIG. 2. FIG. 5 is also a perspective diagram illustrating an example configuration of an electromagnetic induction heating device of the image fixing apparatus of FIG. 2. FIG. 6 is a cross-sectional diagram illustrating an example configuration of a support roller of the image fixing apparatus of FIG. 2. FIG. 7A is a cross-sectional diagram illustrating an example configuration of a support roller of the image fixing apparatus of FIG. 2. FIG. 7B is a cross-sectional diagram illustrating an example configuration of a support roller of the image fixing apparatus of FIG. 2. FIG. 7C is a cross-sectional diagram illustrating an example configuration of a support roller of the image fixing apparatus of FIG. 2. FIG. 7D is a cross-sectional diagram illustrating an example configuration of a support roller of the image fixing apparatus of FIG. 2. A configuration and an operation of the image forming apparatus will be explained by reference to a laser printer 1 as shown in FIG. 1. The laser printer 1 includes an optical writing unit 3, a photoconductor drum 18, an image forming process cartridge 4, a transferring unit 7, a sheet tray 10, sheet feeding units 11 and 12, a registration roller 13, a manual sheet feeder 15, and an image fixing apparatus 20. The optical writing unit 3 emits light L for exposing the photoconductor drum 18 according to image information. The image forming process cartridge 4 is detachable to the laser printer 1. The transferring unit 7 transfers a toner image from the photoconductor drum 18 thereon to a recording medium (sheet) P. The recording medium P is stacked on the sheet tray 10. The recording medium P is fed from the sheet feeding units 11 and 12. The registration roller 13 conveys the recording medium P to the transferring unit 7. The image fixing apparatus 20 fixes the toner image on the recording medium P using electromagnetic induction heating.

The usual image formation of the laser printer 1 will be explained by reference to FIG. 1. The optical writing unit 3 emits light L for exposing the photoconductor drum 18 in the image forming process cartridge 4 according to image information. The photoconductor drum 18 rotates counterclockwise and is used for performing electrophotographic process including an electrification process, an exposure process, and a development process to form toner image thereon according to image information. In the transferring unit 7, the toner image formed on the photoconductor drum 18 is transferred onto the recording medium P which is conveyed with the registration roller 13. The image forming process cartridge 4 includes a non-illustrated electrification device for electrifying the photoconductor drum 18, a non-illustrated development device for developing a latent image on the photoconductor drum 18 using developer (e.g. toner), and a non-illustrated cleaning device for cleaning a waste toner on the photoconductor drum 18 in the body of the image forming process cartridge 4.

The operation of the recording medium P conveyed by the transferring unit 7 is as follows. One of the sheet feeding units 11 and 12, and the manual sheet feeder 15 is selected. For example, the sheet feeding unit 11 is selected. A top recording medium (sheet) P in the sheet feeding unit 11 is conveyed to a position of a conveyance way K. The recording medium P reaches a position of the registration roller 13 through the conveyance way K. Further, the recording medium P is conveyed to the transferring unit 7 with a timing of positioning with the toner image on the photoconductor drum 18.

Next, the recording medium P on which the image is transferred is conveyed to the image fixing apparatus 20. The recording medium P is conveyed between a fixing belt and a pressing roller. The toner image is fixed with a heat from the fixing belt and with a pressure due to the pressing roller. The recording medium P on which the toner image is fixed is output from between the fixing belt and the pressing roller, and it is discharged as an output image from the laser printer 1. In this way, a series of image formation processes are completed.

As shown in FIG. 2, the image fixing apparatus 20 mainly includes an auxiliary fixing roller 21, a fixing belt 22, a support roller 23, an induction heating device 24, a pressing roller 30, a thermistor 38, a guide board 35, a separation board 36, etc.

The auxiliary fixing roller 21 has an elastic layer such as a silicone rubber on the surface of a stainless steel bar. The elastic layer has a thickness of 3 to 10 mm, and an asker hardness of 10 to 50 degrees. The auxiliary fixing roller 21 is rotated counterclockwise in FIG. 2 by a non-illustrated driver.

The support roller 23 serving as a heater, which has a diameter of 20 mm, is equipped with a first heating layer 23*a* (included in a cylinder part) which is made of a magnetic conductivity material having a given Curie point. The first heating layer 23*a* of the support roller 23 is formed so that the thickness (a layer thickness) may be set to about 0.2 mm. The cylinder part also includes second heating layers 23*b*, which have low volume resistivity and a thickness of about 15 μm in each. As shown in FIG. 6, the second heating layers 23*b* are on both sides of the first heating layer 23*a*. The thicknesses of the second heating layers 23*b* are different due to a width position of the support roller 23. This is explained in detail later using FIG. 6.

Specific examples of the a material of the first heating layer 23*a* of the support roller 23 include magnetic conductivity materials such as metals, e.g., nickel, iron, chromium, cobalt, vanadium, and copper, and alloys thereof. In this example, a temperature compensation alloy, which has a Curie point of about 300 degrees or higher than the fixable temperature of the toner, is used as a material of the support roller 23. For example, an alloy of nickel, iron, and chromium, which has a Curie point of about 300 degrees by adjusting the amount of addition and processing conditions of each material is used. Thus, the support roller 23 may be formed with the first heating layer 23*a* which is magnetic conductivity material so that it may have a given Curie point near the fixing temperature of the fixing belt 22. Then, the support roller 23 may be heated by an electromagnetic induction without excessive heating.

The thickness of the first heating layer 23*a* D1 satisfies the next expression 1.

$$3\times\delta 1 \leqq D1 \leqq 17\times\delta 1 \qquad \text{(Expression 1)}$$

The δ1 is a penetrate depth in the case that the temperature of the first heating layer 23*a* is lower than the Curie point. The δ1 is determined due to the volume resistivity and the amplitude permeability of the first heating layer 23*a*, and the frequency of the alternate current impressed to a coil 25. Thereby, the heating efficiency and controllability of the temperature of the support roller 23 may improve.

The volume resistivity of the second heating layers 23*b*, which is a conductive material, is lower than that of the first heating layer 23*a*. For example, the volume resistivity of the first heating layer 23*a* is $8.0\times10^{-7}$ Ω·m. The volume resistivity of the second heating layer 23*b* is $3.0\times10^{-8}$ Ω·m or lower may be possible by using a copper, a gold, a silver, etc. as a material of the second heating layer 23*b*. In this example, a copper as a non-magnetic material is used as the second heating layer 23*b*.

The thickness of the second heating layer 23*b* D2 satisfies the next expression 2.

$$D2 \leqq \delta 2 \qquad \text{(Expression 2)}$$

The δ2 is a penetrate depth of the second heating layer 23*b*. The δ2 is determined due to the volume resistivity and the amplitude permeability of the second heating layer 23*b*, and the frequency of the alternate current impressed to the coil 25. Thereby, the heating efficiency and controllability of the temperature of the support roller 23 may improve.

The support roller 23 rotates counterclockwise in FIG. 2. The coil 25 is provided so that it may face an inner side and an out side of the support roller 23 as shown in FIG. 4. The coil 25 generates magnetic flux. Thereby, the first heating layer 23*a* (a main heat layer) is mainly heated with an electromagnetic induction. The second heating layer 23*b* (an auxiliary heat layer) is subsidiarily heated with an electromagnetic induction. In this example, the support roller 23 includes the first heating layer 23*a* and the second heating layer 23*b*. However, a reinforcement layer, an elastic layer, a heat insulation layer, etc. may also be provided on the heat layer of the support roller 23. Moreover, in order to raise the resistance to rust of the second heating layer 23*b*, the nickel layer having a thickness of about 0.5 micrometers can be provided on the second heating layer 23*b*.

The fixing belt 22 has a heat layer. The fixing belt 22 (a fixing member) as a heating member is supported by the support roller 23 and the auxiliary fixing roller 21. As shown in FIG. 3A, the fixing belt 22 is an endless belt of a multilayer structure where a heat layer 22*b*, an elastic layer 22*c*, a releasing layer 22*d* are formed one by one on a base 22*a*. The base 22*a* is made of a heat-resistant insulating resin material, for example, a polyimide, a polyamide-imide, a PEEK, a PES, a PPS, a fluoro-resin, etc. The base 22*a* has a thickness of 30 to 200 micrometers in consideration of a heat capacity and a strength.

The heat layer 22*b* of the fixing belt 22 is made of a magnetic conductivity material, and the heat layer 22*b* has a thickness of 1 to 20 micrometers. The heat layer 22*b* is formed by plating, sputtering, a vacuum deposition, etc. on the base 22*a*. A magnetic conductivity material such as a nickel, and a stainless steel may be used as a material of the heat layer 22*b*. In this example, a temperature compensation alloy which has a curie point of higher than the temperature that is possible to fix and 350 degrees or less is used as a material of the heat layer 22*b*. The material is an alloy of nickel, iron, and chromium, and a given Curie point may be obtained by adjusting an amount of addition and processing conditions of each material. Thus, the heat layer 22*b* may be formed with a magnetic conductivity material so that it may have a Curie point near the fixing temperature of the fixing belt 22. Then, the heat layer 22*b* may be heated by an electromagnetic induction without excessive heating. This is explained in detail later. Further, the layer 22*b* of the fixing belt 22 may include a first heating layer which has a given Curie point and a second heating layer made of a low volume resistivity material.

The elastic layer 22*c* of the fixing belt 22 is made of a silicone rubber, a fluorosilicone rubber, etc. The elastic layer has a thickness of 50 to 500 micrometers, and an asker hardness of 5 to 50 degrees. Thereby, an output image of uniform quality without gloss unevenness may be obtained.

The releasing-layer 22*d* of the fixing belt 22 is made of a fluoro-resin such as a polytetraflouroethylene resin (PTFE), a perfluoroalkoxy resin (PFA), a fluorinated ethylene propylene resin (FEP), etc., or mixtured these resins, or distributed these resins in a heat-resistant resin. The releasing layer 22*d* has a thickness of 5 to 50 micrometers. Thereby, while a characteristic of releasing toner on the fixing belt 22 is obtained, a pliability of the fixing belt 22 is secured. A primer layer etc. may also be provided between each layer 22*a*, 22*b*, 22*c*, and 22*d* of the fixing belt 22.

As shown in FIG. 3A, the fixing belt 22 includes four layers. As shown in FIGS. 3B, 3C, and 3D, they may have other structures. As shown in FIG. 3B, the fixing belt 22 includes a heat layer 22*b*, an elastic layer 22*c*, and a releasing layer 22*d*. The heat layer 22*b* of the fixing 22 may be made of a fluoro-resin such as a polyimide, a polyamide-imide, a PEEK, a PES, a PPS, a fluoro-resin, etc., or these resins including distributed magnetic conductivity particles. In this case, the resin includes the magnetic conductivity particles with a 20 to 98 weight percent. For example, the magnetic conductivity particles are distributed in the resin of a varnish state with a distributing machine such as a roll mill, a sand mill, a centrifugal mixer, etc. A given layer thickness is obtained with a metallic mold adjusting a viscosity of a solvent.

As shown in FIG. 3C, the fixing belt 22 includes two or more heat layers 22*b* in the base 22*a*, and forms an elastic layer 22*c* and a releasing layer 22*d* one by one on the base 22*a*. As shown in FIG. 3D, the fixing belt 22 forms an elastic layer 22*c* with two or more heat layers 22*b* on a base 22*a*, and further forms a releasing layer 22*d* as a surface layer. This fixing belt 22 has a same effect as this Example 1.

As shown in FIG. 2 and FIG. 4, the induction heating device 24 generates alternate magnetic flux using the coil 25. The coil 25 faces an inner side and an out side of the fixing belt 22 and the support roller 23. A part of the fixing belt 22 and the support roller 23 is in the loop of the coil 25. As shown in FIG. 4, a longitudinal direction of the coil 25 is parallel to the width direction of the fixing belt 22 and the support roller 23. A portion of the coil 25 is folded and the opposite portion of the coil 25 is connected with a high frequency power supply 40. Alternate current of 10 k-1 MHz (preferably 20 k-300 kHz) is applied to the coil 25 from the high frequency power supply 40.

The coil 25 includes a litz wire formed with a plurality of twisted fine leads on which an insulated material is coated. Generally, the loss in applying high frequency current becomes smaller as a lead having shorter diameter is used. However, the strength decreases and is more likely to break apart. Therefore, each diameter of the lead should be greater than 0.05 mm. The diameter is preferably greater than a twice value of the penetrate depth calculated from a frequency of the alternate current. The penetrate depth δ is calculated from the next expression.

$$\delta=503\cdot[\rho/(\mu f)]^{1/2}$$

In the expression, ρ represents the volume peculiar electric resistivity (the volume resistivity) of the material. In the expression, μ represents the amplitude permeability of the material. In the expression, f represents the frequency of the alternate current applied for an excitation of the material.

When the coil 25 includes the litz wire, the capability for flowing the current increases as a large number of leads are used. However, a large number of leads decrease their flexibility and increase their volume. Therefore, in this Example 1, the coil 25 includes the litz wire having 150 leads twisted, and the diameter of the lead is 0.15 mm in each.

In this example, as shown in FIG. 5, the coil 25 may have a plurality of loops to the fixing belt 22 and the support roller 23. At this time, the number of turns of the coil 25 should be 1 to 50 times, and more preferably 1 to 10 times. The coil may include a wire except for the litz wire. Further, a core for reducing a leakage of flux, or an electric conductive cover of low resistance non-magnetic material such as a copper or an aluminum may be provided in a domain that the coil 25 does not face the fixing belt 22 and the support roller 23.

As shown in FIG. 2, the pressing roller 30 has an elastic layer 30*b* such as a fluoride rubber, a silicone rubber, etc. on the surface of a cylinder member which includes an aluminum, a copper, etc. The elastic layer of the pressing roller 30 has a thickness of 1 to 5 mm, and an asker hardness of 20 to 50 degrees. The pressing roller 30 pushes the auxiliary fixing roller 21 through the fixing belt 22 (a fixing member). The recording medium P is conveyed into a nip press region between the fixing belt 22 and the pressing roller 30.

A guide board 35 for guiding the recording medium P is provided at the entrance of the nip press region. A separate board 35 for separating the recording medium P from the fixing belt 22 is provided at the exit of the nip press region.

A thermo sensitive register 38 is in contact with an outer surface of the fixing belt 22 at upstream of the fixing nip press region. A temperature of the fixing belt 22 surface (fixing temperature) is detected with the thermo sensitive register 38, and the output of the induction-heating device 24 is adjusted.

The fixing apparatus 20 operates as follows. The fixing belt 22 as a fixing member rotates in the direction indicated by an arrow in FIG. 2 with rotation of the auxiliary fixing roller 21. The support roller 23 also rotates counterclockwise. The pressing roller 30 also rotates in the direction indicated by an arrow. The fixing belt 22 is heated at a position of the support roller 23.

In more detail, a 10 kHz-1 MHz high frequency alternate current is applied to the coil member 25 from the high frequency power supply 40. A line of magnetic force may be formed so that it may change by turns bidirectionally into the inside of the loop part of the coil member 25. With the magnetic field being formed, when the temperature of the support roller 23 (the first heating layer 23*a*) and the second heating layer 23*b* is below a Curie point, an eddy current arises on the support roller 23 and the heat layer 22*b*. Joule heat occurs and the support roller 23 and the heat layer 22*b* are heated according to the resistances of the support roller 23 and the heat layer 22*b*. In this way, the fixing belt 22 is heated by itself and by the heat received from the heated support roller 23.

After that, the surface of the fixing belt 22 heated with the coil member 25 passes through the position of the thermo sensitive register 38, and reaches a contact point with the pressing roller 30. Then, the toner image T on the recording medium P is heated to melt. In more detail, the recording medium P is guided with the guide board 35, and it is conveyed into between the fixing belt 22 and the pressing roller 30 (it is a movement of the conveyance direction of the arrow Y). The toner image T on the recording medium P is fixed with the heat received from the fixing belt 22 and the pressure from the pressing roller 30. The recording medium P is output from between the fixing belt 22 and the pressing roller 30.

The surface of the fixing belt 22 passed through the position of the pressing roller 30 reaches the position of the support roller 23 again. Such a series of operation is repeated continuously, and the fixing process in an image formation process is completed.

In the fixing process, when the temperature of the support roller 23 (the first heating layer 23*a*) and the heat layer 22*b* exceeds a Curie point, a generation of heat of the support roller 23 and the heat layer 22*b* may be restricted. That is, when the temperature of the support roller 23 and the heat layer 22*b* heated with the induction-heating device 24 exceeds the Curie point, the support roller 23 (the first heating layer 23*a*) and the heat layer 22*b* may lose magnetism. Then, generating of the eddy current near the surface is restricted. Therefore, the amount of generating of the Joule heat in the support roller 23 (the first heating layer 23*a*) and the heat layer 22*b* falls, and an excessive temperature may be controlled.

Such self-temperature control capability especially increases when the coil member 25 is arranged in the shape of a loop to the heat members 22*b* and 23 like this example as compared to a case in which the coil member 25 is arranged at one side (outside) of the heat members 22*b* and 23. Such an effect is explained later with FIGS. 12-14.

In this Example 1, as shown in FIG. 6, the support roller 23 may include a first heating layer 23*a* which has a given Curie point and a second heating layer 23*b* which has a lower volume resistivity than the first heating layer 23*a*. The second heating layers 23*b* are formed on both sides of the first heating layer 23*a*. The thicknesses of the second heating layers 23*b* are different due to a width position of the support roller 23. The second heating layer 23*b* of the out side of the support roller 23 is formed on center in width direction. The second heating layer 23*b* of the out side of the support roller 23 is not formed on both ends of the support roller 23. In this example, the width length of the second heating layer 23*b* of the out side of the support roller 23 is 210 mm which corresponds to the width of A4 size. The thickness and the volume resistivity of the first heating layer 23*a* are uniformly formed in the whole width (326 mm) of the support roller 23.

Even if the Curie point of the first heating layer 23*a* is set a little bit higher (e.g. 300-350° C.) for reducing a rising time of the image forming apparatus, an excessive heat at both ends of the support roller 23 may be suppressed when the small size sheets are continuously fed.

This is considered based on the following reasons. The amount of generating heat and the demagnetizing field of the support roller 23 become large because the volume resistivity of the second heating layers 23*b* is lower than that of the first heating layer 23*a*. Even if an external magnetic field (a coil current) is large or the amplitude permeability or a saturation magnetic flux density decreases near the Curie point, the first heating layer 23*a* is hard to be saturated magnetically when the demagnetizing field becomes large. Therefore, the amount of generating heat at both ends of the support roller 23 may be small compared to the center portion of the support roller 23 at high temperature near the Curie point. Then, the excessive heat at both ends of the support roller 23 may be suppressed when the small size sheets are continuously fed. Examples, which show the above-mentioned effect, will be described later by reference to FIGS. 15 and 16.

When a large recording medium P is fed or at the rising time of the image fixing apparatus, unevenness of temperature in the width direction on the fixing belt 22 or the support roller 23 is reduced because the second heating layer 23*b* is provided in the whole width inner side of the support roller 23.

The other examples of the support rollers 23 as shown in FIGS. 7A, 7B, 7C, and 7D, have the similar effect as the above-mentioned example. As shown in FIG. 7A, the second heating layer 23*b* is provided in the whole width out side of the support roller 23. The second heating layer 23*b* is also provided in the center portion of the width inner side of the support roller 23. As shown in FIG. 7B, the second heating layer 23*b* is not provided inner side of the support roller 23. In this case, the effect due to the second heating layer 23*b* of inner side of the support roller 23 vanishes. As shown in FIG. 7C, the second heating layer 23*b* is provided in the whole width out side of the support roller 23, and the thickness of the center portion is greater than that of the end portions (M1>M2). In this case, the amount of generating heat and the demagnetizing field of the center portion of the support roller 23 also become large compared to the end portions.

As shown in FIG. 7D, the second heating layer 23*b* of out side is provided so that the volume resistivity ρ1 of the center portion is lower than the volume resistivity ρ2 of the end portions. The volume resistivity ρ1 and ρ2 is lower than that of the first heating layer 23*a*. In this case, the amount of generating heat and the demagnetizing field of the center portion of the support roller 23 also become large compared to the end portions.

As mentioned above, the support roller 23 includes the first heating layer 23*a* having a given Curie point, and the second heating layer 23*b* having different thickness and/or different volume resistivity in the width direction of the support roller 23. Thereby, an excessive heat at both ends of the support roller 23 may be suppressed when the small size sheets are continuously fed without extending the rising time of the image fixing apparatus 20. Further, the support roller 23 may have simple structure to control the temperature itself surely.

The second heating layer 22*b* of the fixing belt 22 may be formed with a first heating layer and a second heating layer, and the second heating layer may have different thickness and the volume resistivity in the width direction of the support roller 23. In addition, one of the fixing belt 22 and the support roller may be used as a heat member. In these cases, there is a similar effect compared to the Example 1. When the support roller 23 is used as a heat member mainly, the second heating layer 22*b* of the fixing belt 22 is unnecessary, and the support roller 23 may include a single heating layer, so that the image fixing apparatus 20 may have more simple structure.

For improving fixing quality, the pressing roller 30 may be used as a heat member. In this case, a flux generating device is provided so that it may face the pressing roller 30. The pressing roller 30 may include a first heating layer having a given Curie point, and a second heating layer having different thickness and the volume resistivity in the width direction of the pressing roller 30. Thereby, an excessive heat at both ends of the pressing roller 30 may be suppressed.

EXAMPLE 2

Figure 8:
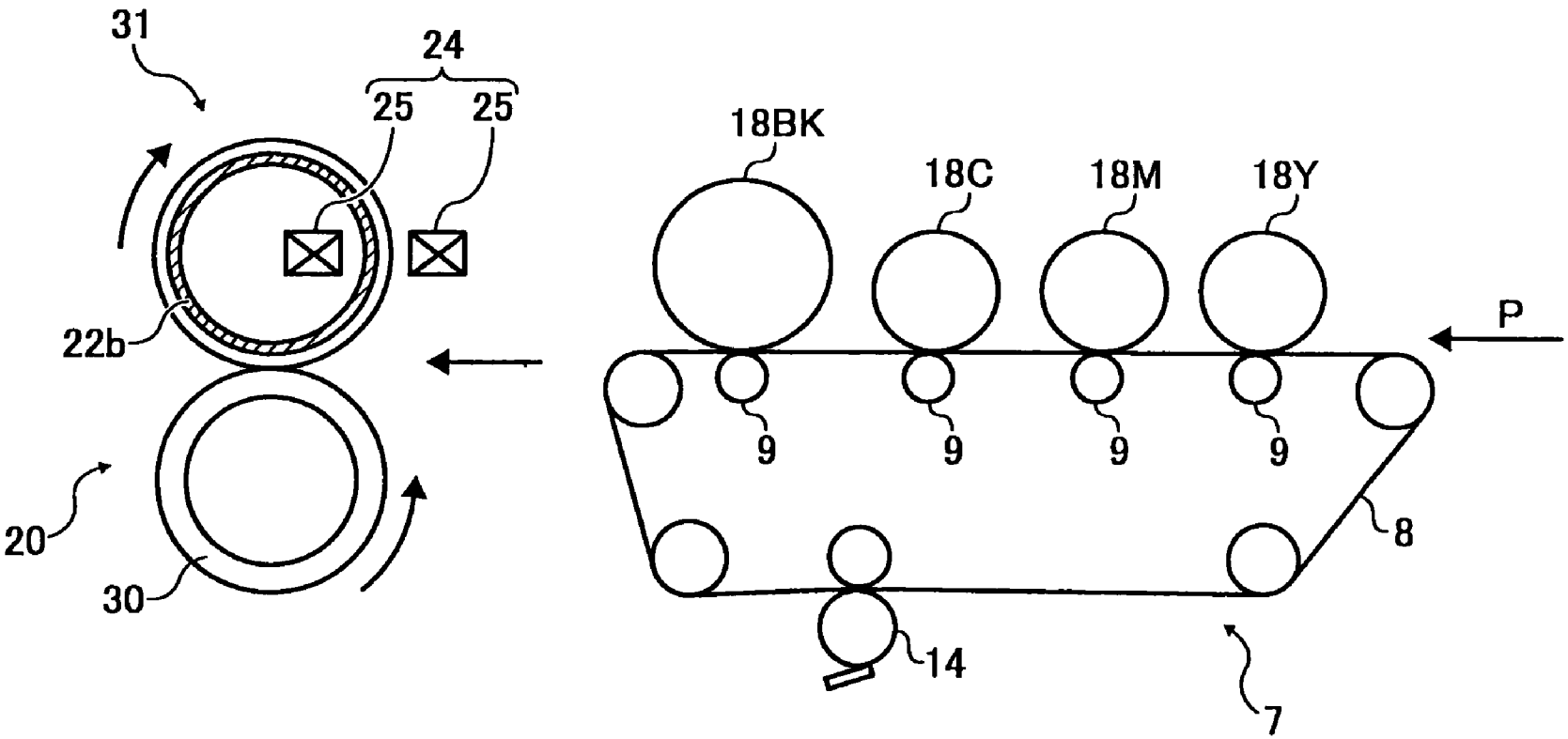
FIG. 8 is a cross-sectional diagram illustrating a main part of an image forming apparatus according to an example embodiment of the present invention.

The second example embodiment of the present invention will be explained by reference to FIG. 8. FIG. 8 is a cross-sectional diagram illustrating a main part of an image forming apparatus according to an example embodiment of the present invention. This image forming apparatus is a tandem type color image forming apparatus. A fixing roller 31 as a heat member is used. These are different points from the Example 1.

As shown in FIG. 8, two or more photoconductor drums 18BK, 18Y, 18M, and 18C are provided beside a transfer belt 8. Like the process cartridge 4 in FIG. 1, an electrification device, an optical writing unit, a development device, a cleaning device, and a neutralization device are provided around each photoconductor drum. However, they are not illustrated. Toner image of each color (black, yellow, magenta, cyan) is formed on the photoconductor drums 18BK, 18Y, 18M, and 18C, respectively.

The transferring unit 7 includes the transfer belt 8, the photoconductor drums 18BK, 18Y, 18M, and 18C, a bias roller 9, and a cleaning roller 14 for cleaning a surface of the transfer belt 8. The transfer belt 8 conveys the recording medium P to the photoconductor drums 18Y, 18M, 18C, and 18BK in turn. The toner images on the photoconductor drums 18Y, 18M, 18C, and 18BK are transferred to recording medium P by a transfer bias with the bias rollers 9. Thus, a full color toner image is formed on the recording medium P. After that, the recording medium. P is separated from the transfer belt 8, and conveyed to the image fixing apparatus 20.

As shown in FIG. 8, the image fixing apparatus 20 in Example 2 mainly includes a fixing roller 31, an induction heating device 24, a pressing roller 30, etc. The fixing roller 31 has a heating layer 22*b* including a first heating layer and a second heating layer, an elastic layer such as a silicone rubber, and a releasing layer such as a fluorine compound. The heating layer 22*b* of the fixing roller 31 includes the first heating layer having a given Curie point, and the second heating layer having lower volume resistivity than the first heating layer. The fixing roller 31 has strength against a pressure from the pressing roller 30.

The induction heating device 24 includes the coil 25 in a similar fashion of Example 1. The coil 25 faces the inner and the out side of the fixing roller 31. In the fixing apparatus 20, a 10 k-1 MHz alternate current is supplied to the coil 25, and a line of magnetic force is formed in the loop of the coil 25. The fixing roller 31 is heated by an electromagnetic induction. The heated fixing roller 31 heats and fixes a toner image on the recording medium P conveyed along the direction of an arrow.

In the image fixing apparatus 20 of this Example 2, the second heating layer of the heating layer 22*b* has different thickness or different volume resistivity in the width direction of the fixing roller 31. For example, the second heating layer of the heating layer 22*b* is provided in the whole width inner side of the fixing roller 31, and the thickness of the center portion is greater than that of the end portions.

As mentioned above, the fixing roller 31 includes the first heating layer having a given Curie point, and the second heating layer having different thickness and/or different low volume resistivity in the width direction of the fixing roller 31. Thereby, an excessive heat at both ends of the fixing roller 31 may be suppressed when the small size sheets are continuously fed without extending the rising time of the image fixing apparatus 20. Further, the fixing roller 31 may have simple structure to control the temperature itself surely.

EXAMPLE 3

Figure 9:
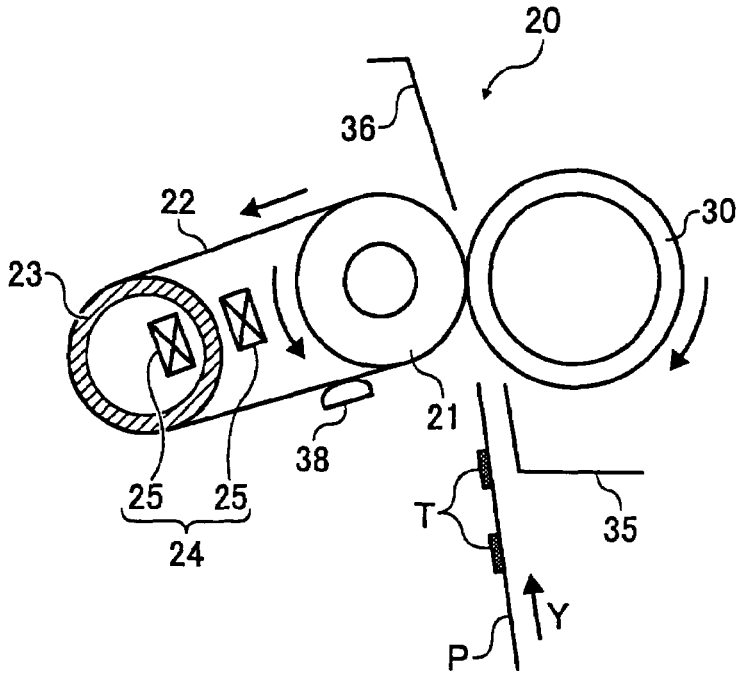
FIG. 9 is a cross-sectional diagram illustrating an image fixing apparatus according to an example embodiment of the present invention.

The third example embodiment of the present invention will be explained by reference to FIG. 9. FIG. 9 is a cross-sectional diagram illustrating an image fixing apparatus according to an example embodiment of the present invention. The location of the induction heating device 24 is different from that of Example 1.

As shown in FIG. 9, the image fixing apparatus 20 in Example 3 mainly includes a fixing belt 22, a support roller 23, an induction heating device 24, a pressing roller 30, etc. The support roller 23 includes a first heating layer 23*a* having a given Curie point, and the second heating layer 23*b* having lower volume resistivity than the first heating layer in a similar fashion of Example 1.

The induction heating device 24 includes the coil 25. The coil 25 faces the inner and the out side of the support roller 23.

In the fixing apparatus 20, a 10 k-1 MHz alternate current is supplied to the coil 25, and a line of magnetic force is formed in the loop of the coil 25. The support roller 23 is heated by an electromagnetic induction. In this Example 3, the fixing belt 22 is not equipped with heat layers, but it reaches a given temperature by the heat of the support roller 23.

In the image fixing apparatus 20 of this Example 3, the second heating layer 23*b* of the support roller 23 has different thickness or different volume resistivity in the width direction of the support roller 23. For example, the second heating layer 23*b* is provided in the whole width on the entire surface of the support roller 23, and the thickness of the center portion is greater than that of the end portions.

As mentioned above, the support roller 23 includes the first heating layer 23*a* having a given Curie point, and the second heating layer 23*b* having different thickness and/or different volume resistivity in the width direction of the support roller 23. Thereby, an excessive heat at both ends of the support roller 23 may be suppressed when the small size sheets are continuously fed without extending the rising time of the image fixing apparatus 20. Further, the support roller 23 may have simple structure to control the temperature itself surely.

EXAMPLE 4

Figure 10:
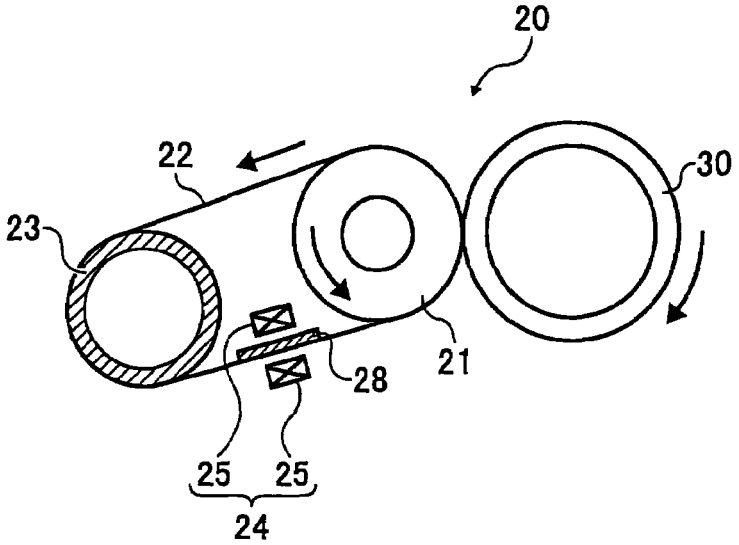
FIG. 10 is a cross-sectional diagram illustrating an image fixing apparatus according to an example embodiment of the present invention.

The fourth example embodiment of the present invention will be explained by reference to FIG. 10. FIG. 10 is a cross-sectional diagram illustrating an image fixing apparatus according to an example embodiment of the present invention. The location of the induction heating device 24 is different from that of Example 1.

As shown in FIG. 10, the image fixing apparatus 20 in Example 4 mainly includes a fixing belt 22, a heat board 28, a support roller 23, an induction heating device 24, a pressing roller 30, etc. The heat board 28 includes a first heating layer having a given Curie point, and the second heating layer having lower volume resistivity than the first heating layer. The heat board 28 is located at upstream portion of the fixing nip region, and applies a given pressure to the inner side of the fixing belt 22.

As shown in FIG. 10, the induction heating device 24 includes the coil 25. The fixing belt 22 and the heat board 28 are sandwiched between the coil 25.

In the fixing apparatus 20, a 10 k-1 MHz alternate current is supplied to the coil 25, and a line of magnetic force is formed in the loop of the coil 25. The heat board 28 is heated by an electromagnetic induction. In this Example 4, the fixing belt 22 is not equipped with heat layers, but it reaches a given temperature by the heat of the heat board 28.

In the image fixing apparatus 20 of this Example 4, the second heating layer of the heat board 28 has different thickness or different volume resistivity in the width direction of the heat board 28. For example, the second heating layer is provided in the whole width of the heat board 28, and the thickness of the center portion is greater than that of the end portions.

As mentioned above, the heat board 28 includes the first heating layer having a given Curie point, and the second heating layer having different thickness and/or different volume resistivity in the width direction of the heat board 28. Thereby, an excessive heat at both ends of the heat board 28 may be suppressed when the small size sheets are continuously fed without extending the rising time of the image fixing apparatus 20. Further, the heat board 28 may have simple structure to control the temperature itself surely. In this Example 4, the heat board 28 is used. How ever, the first heating layer and the second heating layer may be provided on the fixing belt 22 without using the heat board 28. In this case, it may have a similar effect of the Example 4.

EXAMPLE 5

Figure 11:
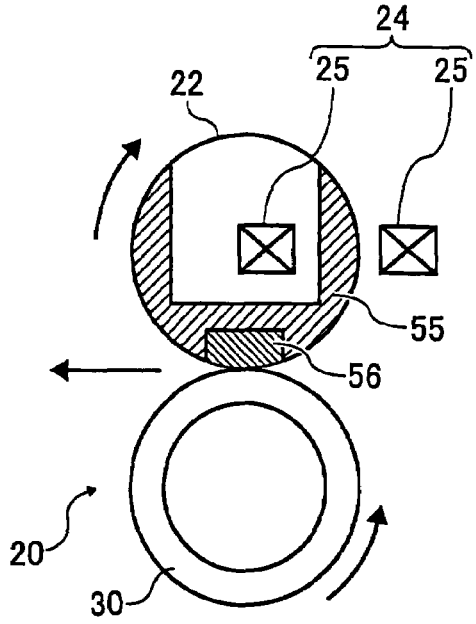
FIG. 11 is a cross-sectional diagram illustrating an image fixing apparatus according to an example embodiment of the present invention.

The fifth example embodiment of the present invention will be explained by reference to FIG. 11. FIG. 11 is a cross-sectional diagram illustrating an image fixing apparatus according to an example embodiment of the present invention. A fixing belt 22 as a heat member forming a circle in FIG. 11 is used. Using fixing belt is mainly different from Example 2 in which the fixing roller 31 is used.

As shown in FIG. 11, the image fixing apparatus 20 in Example 5 mainly includes a fixing belt 22, a holding member 55 for folding the fixing belt 22, an elastic member 56 for forming a fixing nip region, an induction heating device 24, a pressing roller 30, etc. The fixing belt 22 includes a first heating layer having a given Curie point, and the second heating layer having lower volume resistivity than the first heating layer.

In the fixing apparatus 20, a 10 k-1 MHz alternate current is supplied to the coil 25 in the induction heating device 24, a line of magnetic force is formed in the loop of the coil 25. The fixing belt 22 is heated by an electromagnetic induction. The heated fixing belt 22 heats and fixes a toner image on the recording medium P conveyed in the direction of an arrow.

In the image fixing apparatus 20 of this Example 5, the second heating layer of the fixing belt 22 has different thickness or different volume resistivity in the width direction of the fixing belt 22. For example, the second heating layer is provided in the whole width of the fixing belt 22, and the thickness of the center portion is greater than that of the end portions.

As mentioned above, the fixing belt 22 includes the first heating layer having a given Curie point, and the second heating layer having different thickness and/or different volume resistivity in the width direction of the fixing belt 22. Thereby, an excessive heat at both ends of the fixing belt 22 may be suppressed when the small size sheets are continuously fed without extending the rising time of the image fixing apparatus 20. Further, the fixing belt 22 may have simple structure to control the temperature itself surely.

Figure 12A:
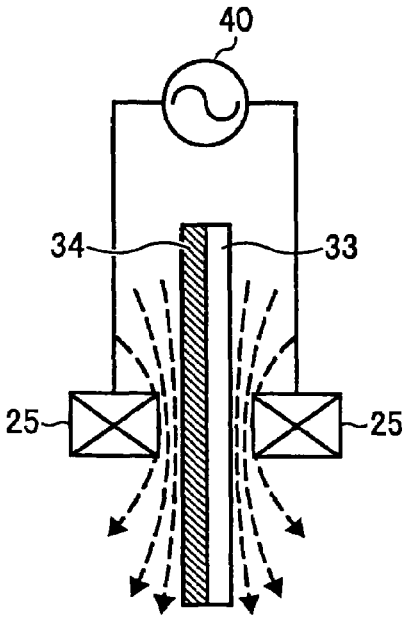
FIG. 12A is a cross-sectional diagram illustrating a configuration of around a coil member as an experimental apparatus related to the image fixing apparatus of FIG. 2.
Figure 12B:
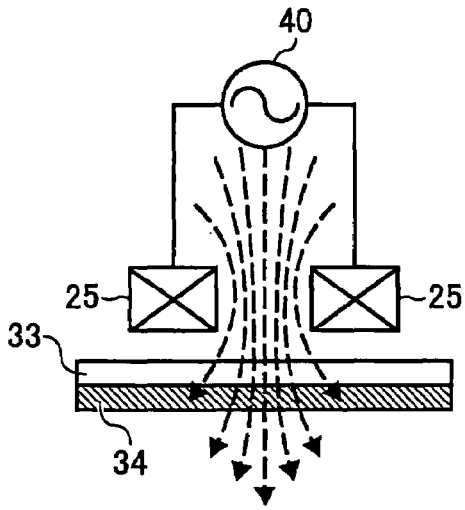
FIG. 12B is a cross-sectional diagram illustrating another configuration of around a coil member as an experimental apparatus related to the image fixing apparatus of FIG. 2.
Figure 13A:
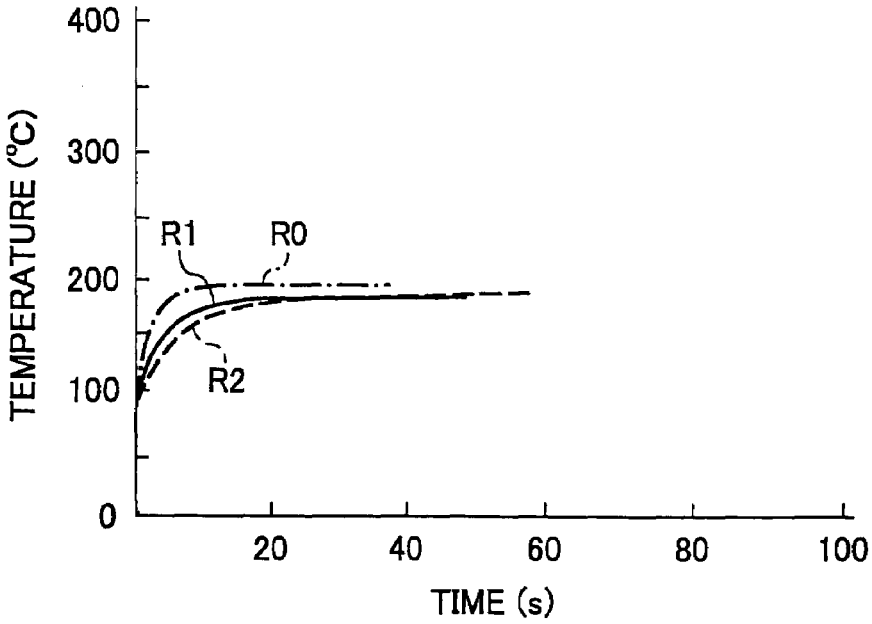
FIG. 13A is a graph showing a rising temperature of a heat layer of the experimental apparatus of FIG. 12A.
Figure 13B:
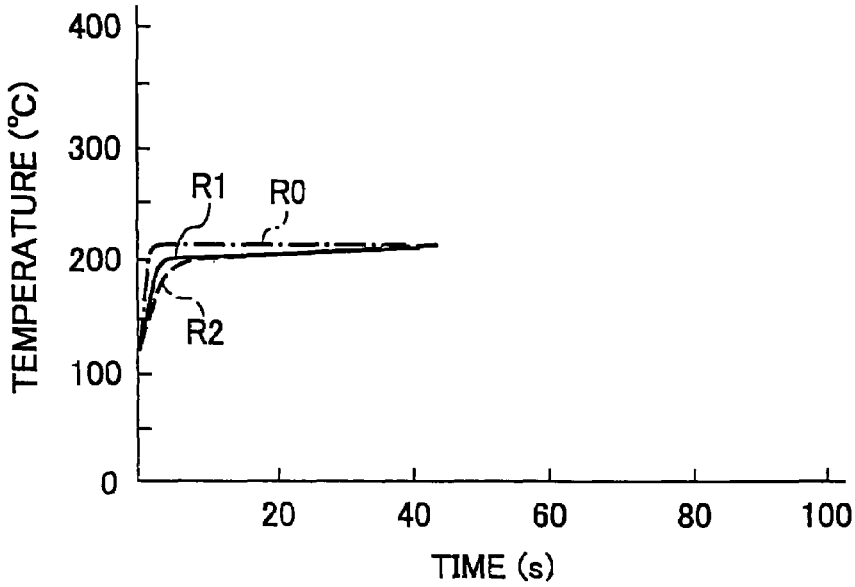
FIG. 13B is also a graph showing a rising temperature of a heat layer of the experimental apparatus of FIG. 12A.
Figure 14A:
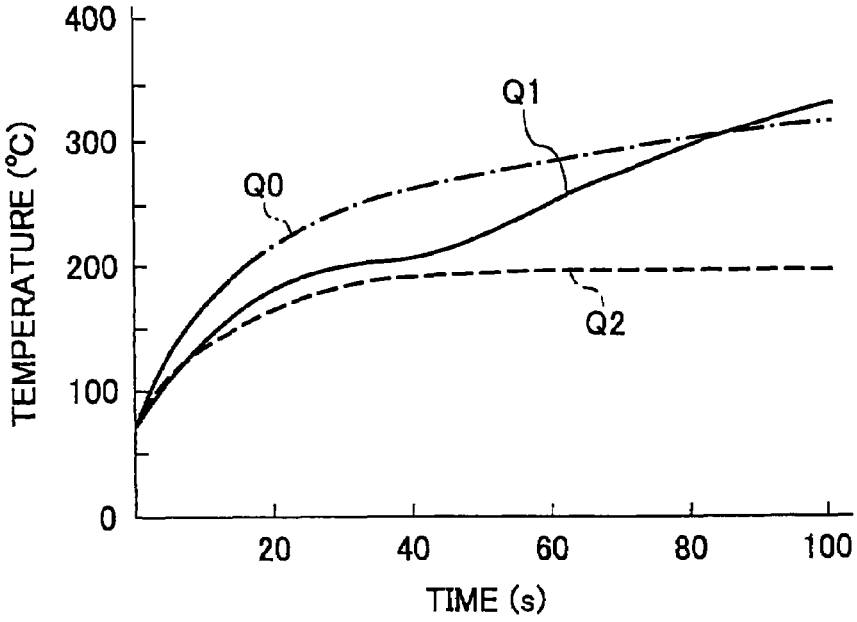
FIG. 14A is a graph showing a rising temperature of a heat layer of the experimental apparatus of FIG. 12B.
Figure 14B:
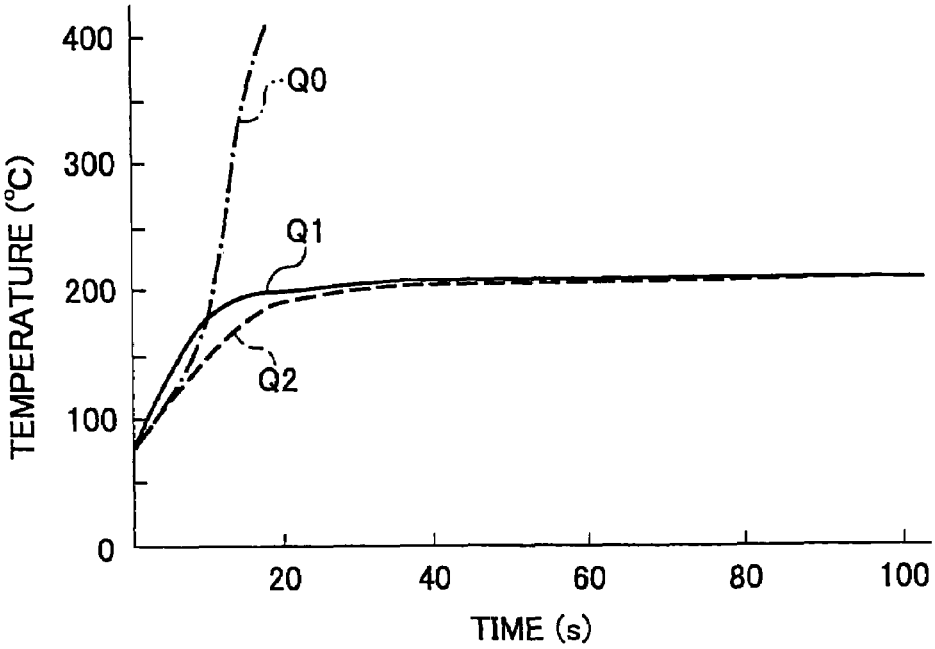
FIG. 14B is also a graph showing a rising temperature of a heat layer of the experimental apparatus of FIG. 12B.

(Experimental results) Next, experimental results are explained for describing controllability of temperature of a heat member itself using FIG. 12A through FIG. 14B. FIG. 12A is a cross-sectional diagram illustrating a configuration of around a coil member as an experimental apparatus related to the image fixing apparatus of FIG. 2. FIG. 12B is a cross-sectional diagram illustrating another configuration of around a coil member as an experimental apparatus related to the image fixing apparatus of FIG. 2. FIG. 13A is a graph showing a rising temperature of a heat layer of the experimental apparatus of FIG. 12A. FIG. 13B is also a graph showing a rising temperature of a heat layer of the experimental apparatus of FIG. 12A. FIG. 14A is a graph showing a rising temperature of a heat layer of the experimental apparatus of FIG. 12B. FIG. 14B is also a graph showing a rising temperature of a heat layer of the experimental apparatus of FIG. 12B. As shown in FIG. 12A, the experimental apparatus has a coil member 25 facing a front and a back side of a test piece having a heat layer 33 which is equivalent to a heat member. As shown in FIG. 12B, the experimental apparatus has a coil member 25 facing one side of a test piece having a heat layer 33 which is equivalent to a heat member.

That is, as shown in FIGS. 12A and 12B, the direction of the test piece against the coil 25 is mainly different.

A first test piece only includes the heat layer 33. A second test piece has a non-magnetic Aluminum electric conduction layer 34 having a thickness of 0.3 mm, which is on the heat layer 33. A third test piece has a non-magnetic Aluminum electric conduction layer 34 having a thickness of 0.8 mm, which is on the heat layer 33. The heat layer 33 is made of a temperature compensation alloy which has a Curie point of 240 degrees C. The heat layer 33 has an area of 25 mm×50 mm, and has a thickness of 0.22 mm. The non-magnetic Aluminum electric conduction layer 34 also has an area of 25 mm×50 mm.

The high frequency power supply 40 has an electric power of 200 to 1200 W, and two kinds of alternate current (36 kHz and 130 kHz for excitation frequency) are applied to the coil member 25 of the experimental apparatus. A line of magnetic force as shown in FIGS. 12A and 12B is formed in about coil member 25.

FIGS. 13A, 13B, 14A, and 14B show experimental results. In FIGS. 13A, 13B, 14A, and 14B, a horizontal axis is a time after starting electromagnetic induction, and a vertical axis is a temperature on the heat layer 33.

FIG. 13A is a graph which shows the relation of the time and temperature when the high frequency power supply 40 has a 36 kHz frequency. FIG. 13B is a graph which shows the relation of the time and temperature when the high frequency power supply 40 has a 130 kHz frequency. A line R0 shows a result of using the first test piece. A line R1 shows a result of using the second test piece. A line R2 shows a result of using the third test piece.

FIG. 14A is a graph which shows the relation of the time and temperature when the high frequency power supply 40 has a 36 kHz frequency. FIG. 14B is a graph which shows the relation of the time and temperature when the high frequency power supply 40 has a 130 kHz frequency. A line Q0 shows a result of using the first test piece. A line Q1 shows a result of using the second test piece. A line Q2 shows a result of using the third test piece.

As shown in FIGS. 13A and 13B, there is no relation to an existence of the non-magnetic electric conduction layer 34, or the frequency of the alternate current. When the temperature of the heat layer 33 reaches a Curie point, an excessive temperature rising is prevented after that. On the other hand, as shown in FIG. 14A, when the excitation frequency is 36 kHz, an excessive temperature rising of the heat layer 33 may not be prevented without the non-magnetic electric conduction layer 34 which has a thickness of 0.8 mm or more. As shown in FIG. 14B, when the excitation frequency is 130 kHz, an excessive temperature rising of the heat layer 33 may not be prevented without the non-magnetic electric conduction layer 34 which has a thickness of 0.3 mm or more. Thus, when the coil member 25 is faced to one side of a heat member (a heat layer 33), it is necessary to provide a non-magnetism and electric conduction layer of low electric resistivity on the opposite side of the heat member.

The above results show that the capability of self-temperature control of a heat member is increased by inserting the heat member into the loop-shaped coil member 25. Comparing FIGS. 13A, 13B, 14A, and 14B, the heat efficiency (a rise up) of a heat member also improves by inserting the heat member into the loop-shaped coil member 25. Further, since an above-mentioned effect is obtained without forming the non-magnetic-electric conduction layer 34 in a heat member, a composition of the heat member may be simplified. Therefore, a heat member without the fault such as peeling between layers may be provided, which is low cost.

Figure 15:
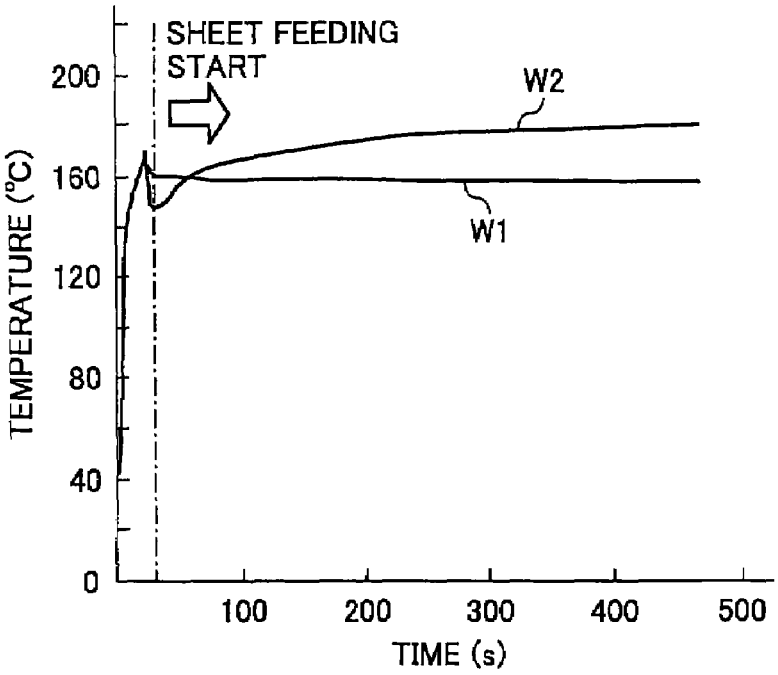
FIG. 15 is a graph showing a rising temperature of a fixing belt of the image forming apparatus of FIG. 1.
Figure 16:
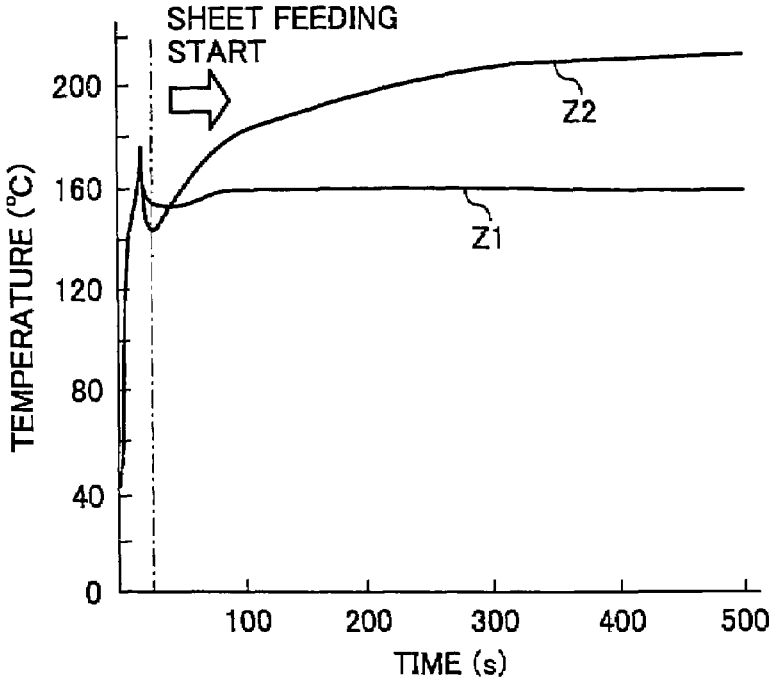
FIG. 16 is also a graph showing a rising temperature of a fixing belt of the image forming apparatus of FIG. 1.

Next, experimental results are explained using FIGS. 15 and 16 for describing an effect that an excessive heat at both ends of a heat member is suppressed due to forming a first heating layer having a given Curie point and a second heating layer having different thickness and/or different volume resistivity in the width direction of the heat member when the small size sheets are continuously fed. FIG. 15 is a graph showing a rising temperature of a fixing belt of the image forming apparatus of FIG. 1. FIG. 16 is also a graph showing a rising temperature of a fixing belt of the image forming apparatus of FIG. 1. In the experiment, the small size sheets are continuously fed, and the temperature in the width direction of the fixing belt 22 is detected. In more detail, one experimental sample has the second heating layer 23*b* at center portion in the width direction. The other experimental sample has the second heating layer 23*b* in the whole width. A rising temperature at the center portion and the end portions was measured. In the experiment, with the thermo sensitive register 38 which detects temperature of the center part of the fixing belt 22, temperature adjustment was carried out so that the fixing temperature of the fixing belt 22 may have a 160 degrees C. A moving speed of the fixing belt is set to 205 mm/s at fixing nip region. When the recording media P are continuously fed, the length between the recording media P is set to 61 mm. An A4 size paper sheet (type: 90K) is used as the recording medium P.

FIGS. 15, and 16 show experimental results. In FIGS. 15, and 16, a horizontal axis is a time after starting electromagnetic induction, and a vertical axis is a temperature on the fixing belt 22. In FIG. 15, the support roller 23 has the second heating layer 23*b* at center portion in the width direction. A line W1 shows a result of the temperature at center portion in the width direction. A line W2 shows a result of the temperature at end portions of the fixing belt 22. In FIG. 16, the support roller 23 has the second heating layer 23*b* in the whole width. A line Z1 shows a result of the temperature at the center portion in the width direction. A line Z2 shows a result of the temperature at end portions of the fixing belt 22.

As shown in FIGS. 15 and 16, providing the support roller 23 which has the second heating layer 23*b* at center portion in the width direction reduces an excessive heat at both ends of the heat member when the small size sheets are continuously fed. Although the experimental is not described, each of the support rollers 23 shown in FIGS. 7A, 7B, 7C, and 7D has similar effect. That is, providing a heat member which has different thickness and/or different volume resistivity in the second heating layer in the width direction reduces an excessive heat at both ends of the heat member when the small size sheets are continuously fed.

This invention is not limited to the above-mentioned examples. It is clear that the form of each above-mentioned example may be suitably changed within the limits of this invention. Also, the number of components, a position, form, etc. are not limited to the form of each above-mentioned example, when carrying out this invention, they may have a suitable number, a position, form, etc.

Numerous additional modifications and variations are possible in light of the above teachings. It is therefore to be understood that within the scope of the appended claims, the disclosure of this patent specification may be practiced otherwise than as specifically described herein.

This patent specification is based on Japanese patent applications, No. JPAP2006-166987 filed on Jun. 16, 2006 in the Japan Patent Office, the entire contents of which are incorporated by reference herein.

What is claimed:

1. An image fixing apparatus to fix a toner image on a recording medium, comprising:

a magnetic flux generating member to generate a magnetic flux; and a heat member to generate heat with the magnetic flux, including a first heat layer, and a second heat layer having a higher volume resistivity than the first heat layer, and having at least one of different thickness and different volume resistivity depending on a position in a width direction thereof;

wherein portions of the magnetic flux generating member face different sides of the heat member.

2. The image fixing apparatus of claim 1, wherein a relative center portion of the second heat layer is thicker in the width direction than both relative end portions of the second heat layer.

3. The image fixing apparatus of claim 1, wherein a relative center portion of the second heat layer has a lower volume resistivity in the width direction than both relative end portions of the second heat layer.

4. The image fixing apparatus of claim 1, wherein the second heat layer is formed at a relative center portion, and not at relative end portions of the heat member.

5. The image fixing apparatus of claim 1, wherein the second heat layer is made of a non-magnetic material.

6. The image fixing apparatus of claim 1, wherein the first heat layer has uniform thickness and volume resistivity in the width direction.

7. The image fixing apparatus of claim 1, wherein the first heat layer is made of a temperature compensation alloy.

8. The image fixing apparatus of claim 1, wherein the second heat layer is provided on both sides of the first heat layer.

9. The image fixing apparatus of claim 1, wherein the magnetic flux generating member includes a coil, separated from the heat member and facing two different sides of the heat member.

10. The image fixing apparatus of claim 1, wherein an alternate current is applied to the magnetic flux generating member.

11. The image fixing apparatus of claim 1, further comprising:

a fixing member configured to fix the toner image;

wherein the heat member is used to heat the fixing member.

12. The image fixing apparatus of claim 11, wherein the fixing member includes a fixing belt, and the heating member includes a support roller configured to support the fixing belt, the image fixing apparatus further comprising:

a pressing roller; and an auxiliary fixing roller to apply a tension to a fixing belt with the support roller and to press the recording medium with the pressing roller with the fixing belt therebetween, and wherein the magnetic flux generating member faces an outer surface of the fixing belt and faces an inner surface of the fixing belt with the support roller therebetween.

13. The image fixing apparatus of claim 1, wherein the heat member includes a fixing member configured to fix the toner image on the recording medium.

14. The image fixing apparatus of claim 13, further comprising:

a pressing roller to apply pressure to the recording medium, wherein the heat member includes a fixing roller to fix the toner image on the recording medium, and wherein the magnetic flux generating member faces an outer and an inner side of the fixing roller.

15. The image fixing apparatus of claim 13, wherein the heat member includes a fixing belt to fix the toner image on the recording medium, being tensed to form a circle-like shape, and wherein the magnetic flux generating member faces an outer and an inner side of the fixing belt.

16. The image fixing apparatus of claim 15, wherein the heat member includes a support roller, the image fixing apparatus further comprising:

a pressing roller; and an auxiliary fixing roller to apply a tension to the fixing belt with the support roller and to press the recording medium with the pressing roller with the fixing belt therebetween.

17. The image fixing apparatus of claim 16, wherein the magnetic flux generating member is arranged to face the inner surface of the fixing belt, with the support roller therebetween.

18. An image forming apparatus comprising:

a latent image bearer to bear a latent image thereon;

a development apparatus to develop the latent image with a developer including a toner; and an image fixing apparatus as claimed in claim 1, to fix a toner image on a recording medium.

19. An image forming apparatus comprising:

a latent image bearer to bear a latent image thereon;

a development apparatus to develop the latent image with a developer including a toner; and an image fixing apparatus as claimed in claim 14, to fix a toner image on a recording medium.

20. An image forming apparatus comprising:

a latent image bearer to bear a latent image thereon;

a development apparatus to develop the latent image with a developer including a toner; and an image fixing apparatus as claimed in claim 15, to fix a toner image on a recording medium.

* * * * *